US006526718B2

(12) United States Patent
Manning et al.

(10) Patent No.: US 6,526,718 B2
(45) Date of Patent: Mar. 4, 2003

(54) REINFORCED VINYL SIDING

(75) Inventors: John M. Manning, Worthington, OH (US); Michael K. Scott, Hilliard, OH (US)

(73) Assignee: Crane Plastics Company LLC, Columbus, OH (US)

( * ) Notice: Subject to any disclaimer, the term of this patent is extended or adjusted under 35 U.S.C. 154(b) by 0 days.

(21) Appl. No.: 09/990,806

(22) Filed: Nov. 21, 2001

(65) Prior Publication Data

US 2002/0029537 A1 Mar. 14, 2002

Related U.S. Application Data

(63) Continuation of application No. 09/111,107, filed on Jul. 6, 1998, now Pat. No. 6,321,500.
(60) Provisional application No. 60/079,476, filed on Mar. 26, 1998.

(51) Int. Cl.[7] ..... E04D 1/00
(52) U.S. Cl. ..... 52/555; 52/560; 52/309.8; 52/314
(58) Field of Search ..... 52/309.8, 314, 52/555, 560, 530

(56) References Cited

U.S. PATENT DOCUMENTS

| | | | | | |
|---|---|---|---|---|---|
| 3,552,078 | A | | 1/1971 | Mattes | 52/520 |
| 3,826,054 | A | * | 7/1974 | Culpepper, Jr. | 52/556 X |
| 4,033,802 | A | | 7/1977 | Culpepper, Jr. et al. | 52/522 |
| 4,034,528 | A | | 7/1977 | Sanders et al. | 52/309.4 |
| 4,081,939 | A | | 4/1978 | Culpepper, Jr. et al. | 52/535 |
| 4,096,011 | A | | 6/1978 | Sanders et al. | 156/196 |
| 4,279,106 | A | | 7/1981 | Gleason et al. | 52/309.8 |
| 4,320,613 | A | * | 3/1982 | Kaufman | 52/521 |
| 4,327,528 | A | | 5/1982 | Fritz | 52/309.1 |
| D274,947 | S | | 7/1984 | Culpepper, Jr. et al. | 52/541 |
| 4,506,486 | A | | 3/1985 | Culpepper, Jr. et al. | 52/529 |
| 4,930,287 | A | | 6/1990 | Volk et al. | 52/748 |
| 4,969,302 | A | * | 11/1990 | Coggan et al. | 52/309.8 |
| 5,024,045 | A | | 6/1991 | Fluent et al. | 53/443 |
| 5,306,548 | A | | 4/1994 | Zabrocki et al. | 428/215 |
| 5,347,784 | A | | 9/1994 | Crick et al. | 52/314 X |
| 5,465,543 | A | * | 11/1995 | Seifert | 52/309.8 |
| 5,598,677 | A | | 2/1997 | Rehm, III | 52/530 |
| 6,029,415 | A | * | 2/2000 | Culpepper et al. | 52/522 |

* cited by examiner

*Primary Examiner*—Carl D. Friedman
*Assistant Examiner*—Brian E. Glessner
(74) *Attorney, Agent, or Firm*—Standley & Gilcrest LLP

(57) ABSTRACT

The present invention comprises a siding unit which is adapted for installation. An exemplary embodiment of the siding unit has at least 1.5 courses of vinyl siding. The courses of vinyl siding are preferably formed by one or more facing panels which are comprised of polyvinyl chloride. A reinforcing panel is glued or otherwise laminated to the inside of each course of vinyl siding. The reinforcing panel is preferably comprised of expanded or extruded polystyrene.

3 Claims, 6 Drawing Sheets

REINFORCED VINYL SIDING

This application is a continuation of U.S. patent application Ser. No. 09/111,107, filed Jul. 6, 1998, now U.S. Pat. No. 6,321,500, which claims the benefit of U.S. Provisional Application No. 60/079,476, filed Mar. 26, 1998.

BACKGROUND AND SUMMARY OF THE INVENTION

The present invention relates generally to building siding, and more particularly, to a reinforced vinyl siding. Vinyl siding is commonly used as exterior siding for homes. It may also be used as exterior siding for buildings and structures of all types.

Vinyl siding is a popular substitute for wood paneling and aluminum siding. It is easily cleaned, and it is resistant to deterioration. It may also be easily installed around windows and doors. Moreover, it may be produced in a variety of shapes and colors by known extrusion and molding processes at a relatively low cost per sheet or panel.

In order to enhance the thermal insulation of building structures, it is known to provide one or more layers or panels of insulating material between the vinyl facing panel and the building structure. Known insulated siding systems exist in many different forms. For instance, it is known to nail large sheets of insulating material to the building structure and then install the siding over the insulating material. Another system places a panel of insulating material in a slot behind the vinyl facing panel. Yet another system pours a foam filler into the back of a vinyl facing panel such that the foam filler conforms to the geometry of the vinyl facing panel.

The present invention is an improvement over each of the aforementioned systems. An exemplary embodiment of the present invention provides a siding unit which is comprised of a reinforcing panel and at least two courses of vinyl siding. Another exemplary embodiment of the present invention provides a siding unit which is comprised of a reinforcing panel and at least 1 course, e.g., 1.5 courses, of vinyl siding. The courses of vinyl siding are preferably formed by one or more facing panels which are comprised of polyvinyl chloride. The reinforcing panel is glued or otherwise laminated to the inside of each course of vinyl siding. The reinforcing panel is preferably comprised of expanded or extruded polystyrene.

In addition to the novel features and advantages mentioned above, other objects and advantages of the present invention will be readily apparent from the following descriptions of the drawings and exemplary embodiments.

DETAILED DESCRIPTION OF EXEMPLARY EMBODIMENT(S)

Figure 1:
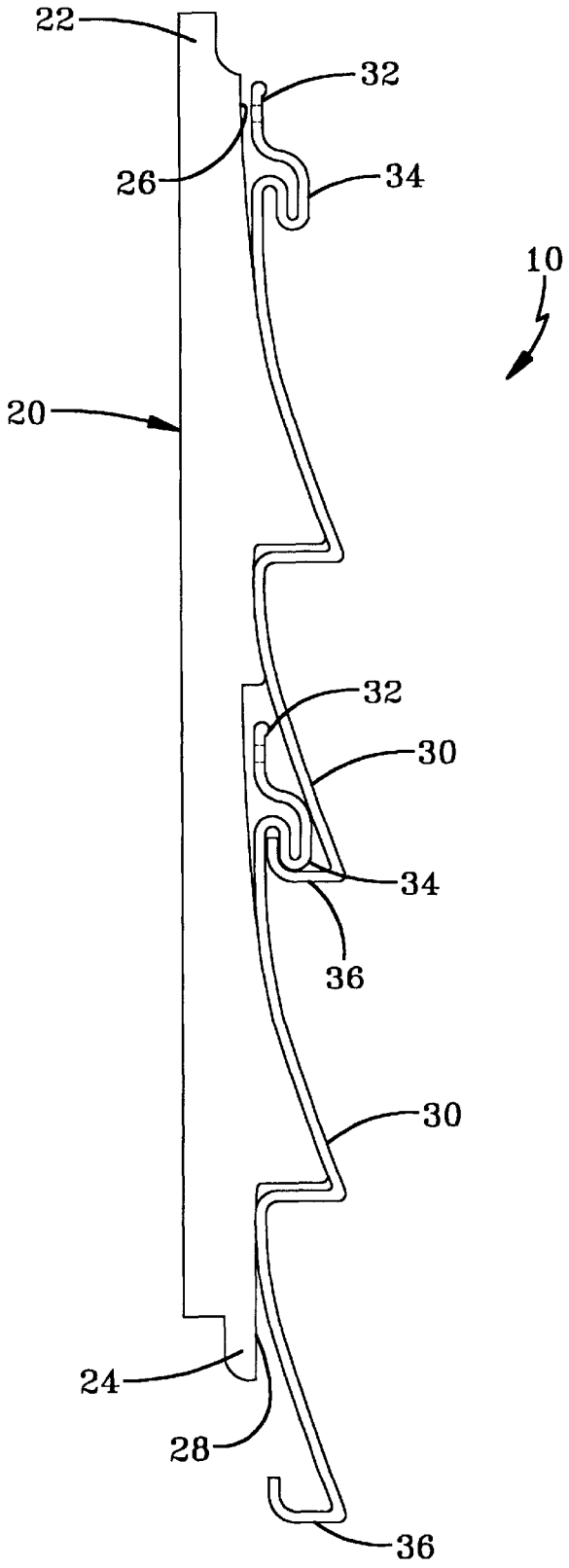
FIG. 1 is a side elevation view of an exemplary embodiment of a siding unit of the present invention.
Figure 2:
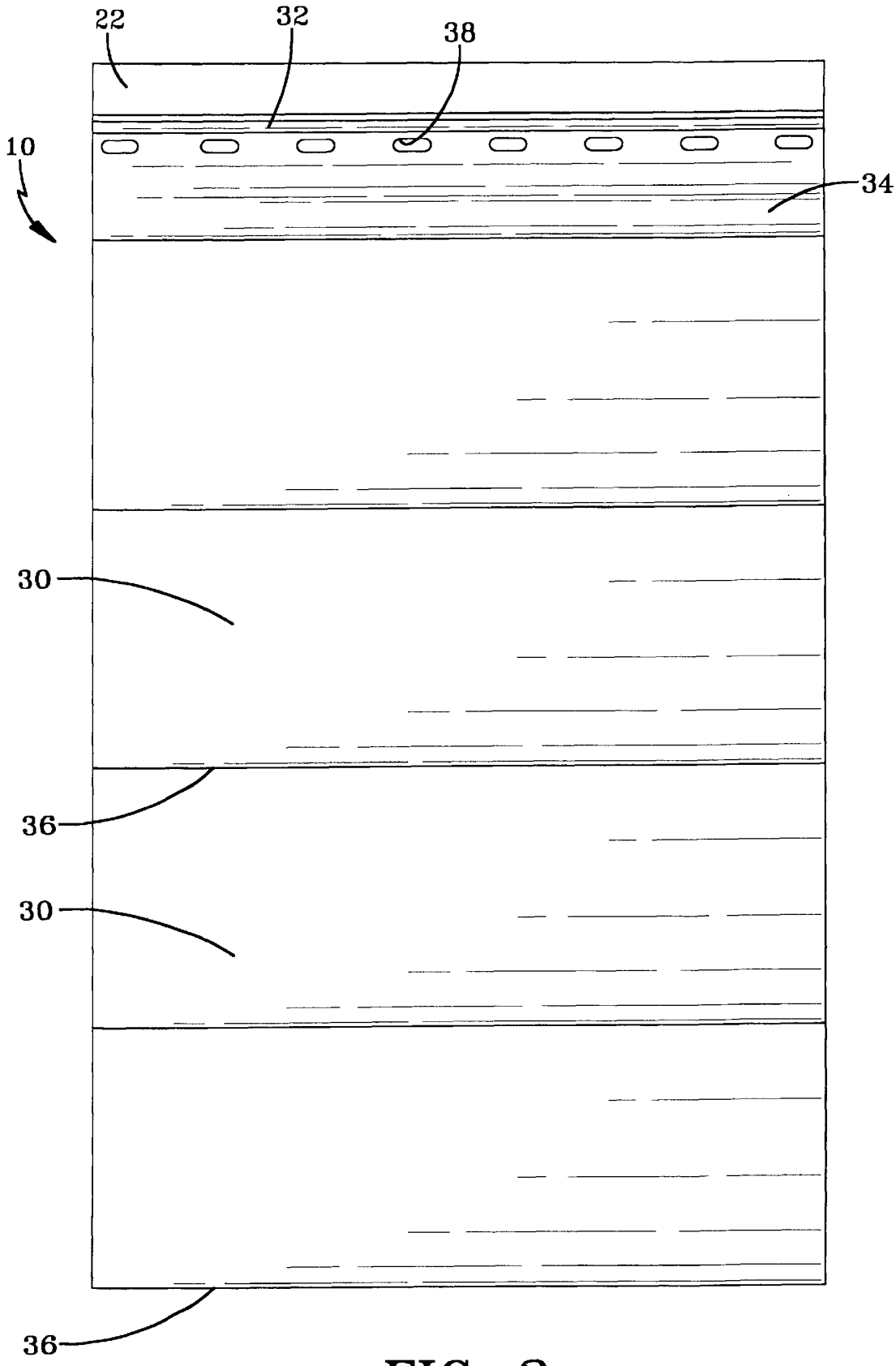
FIG. 2 is an exterior plan view of the siding unit of FIG. 1.
Figure 3:
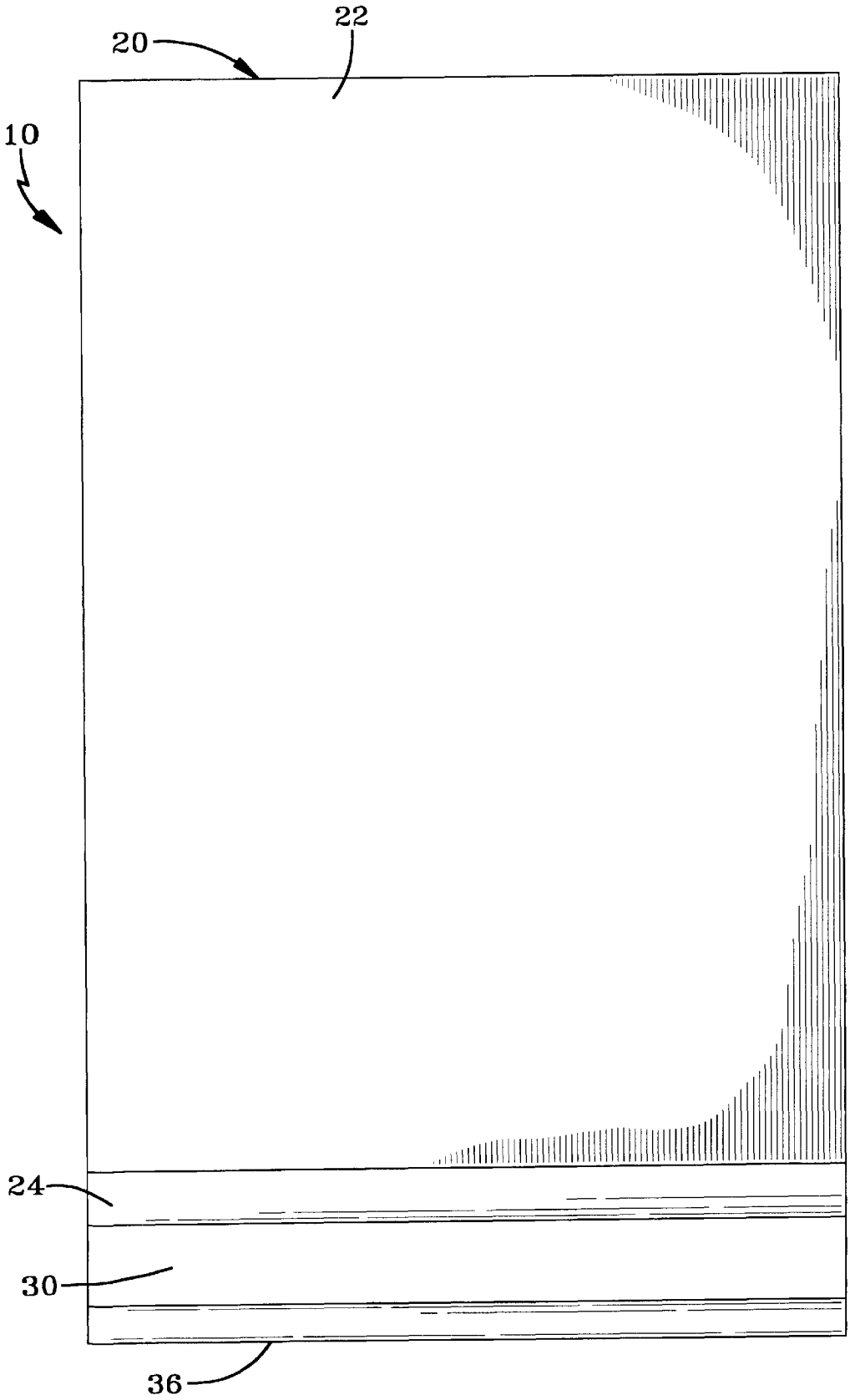
FIG. 3 is an interior plan view of the siding unit of FIG. 1.

The present invention is directed to a reinforced vinyl siding unit. FIGS. 1 through 3 illustrate an exemplary embodiment of a siding unit 10 of the present invention. This embodiment of the siding unit 10 includes a reinforcing panel 20 and at least one facing panel 30. As shown in FIGS. 1 and 2, this embodiment of the siding unit 10 includes two substantially identical facing panels 30.

The height of an exemplary embodiment of a siding unit 10 is preferably between 16 and 36 inches in order to maximize the benefits of the present invention. Those skilled in the art will recognize that the height of a siding unit 10 may also be a desired height less than 16 inches or greater than 36 inches.

It is preferred that a reinforcing panel 20 is comprised of a foam base of either expanded polystyrene or extruded polystyrene. However, it should be recognized that a reinforcing panel 20 may be comprised of any sufficiently rigid, insulating material including, but not limited to, foam, fiberglass, and cardboard. For example, a reinforcing panel 20 may be comprised of a fire retardant grade of polyurethane foam.

In an exemplary embodiment of a siding unit 10, a facing panel 30 is comprised of polyvinyl chloride (PVC). It should be recognized, however, that a facing panel 30 may be comprised of any thermoplastic material. The thermoplastic material may include polyolefins, polyvinyls, polycarbonates, polyacetals, polysulfones, polyesters, polyamides, multilayer films, polyethylene (HDPE), polypropylene, low density polyethylene (LDPE), CPVC ABS, ethyl-vinyl acetate, other similar polyethylene copolymers, other similar thermoplastic materials, or formulations that incorporate any of the aforementioned thermoplastic materials.

The thickness of a facing panel 30 is preferably in a range between 0.030 and 45 mils in order to maximize the benefits of the present invention. The thickness of a facing panel 30, however, is not pertinent to the patentability of the present invention. The thickness of a facing panel 30 may also be a desired dimension less than 30 mils or greater than 45 mils.

Figure 5:
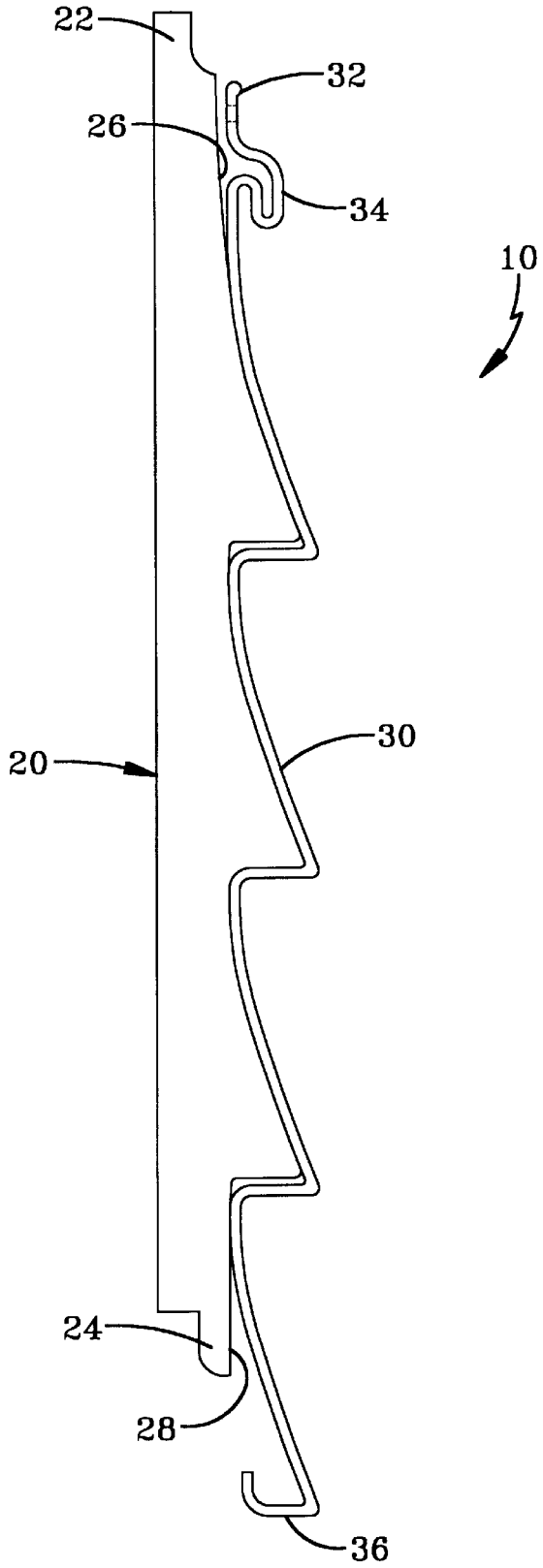
FIG. 5 is a side elevation view of an alternative embodiment of a siding unit of the present invention.

As shown in FIGS. 1 and 5, it is preferred that the shape of a reinforcing panel 20 conforms in a mating fashion to the inside of the at least one facing panel 30 such that a siding unit assembly 10 is generally solid. It should be recognized that a siding unit 10 may still be generally solid and that a reinforcing panel 20 may still reinforce the at least one facing panel 30 even though there may be deviations in the surface of a reinforcing panel 20 or there may be gaps between a reinforcing panel 20 and a facing panel 30. The shape of a reinforcing panel 20 preferably does not interfere with the interlocking mechanisms between adjacent facing panels 30. Any suitable means may be used to obtain the shape of a reinforcing panel 20. In an exemplary embodiment, the shape of a reinforcing panel 20 is obtained by extrusion through a predetermined die configuration and/or by cutting such as with a power saw.

Figure 4:
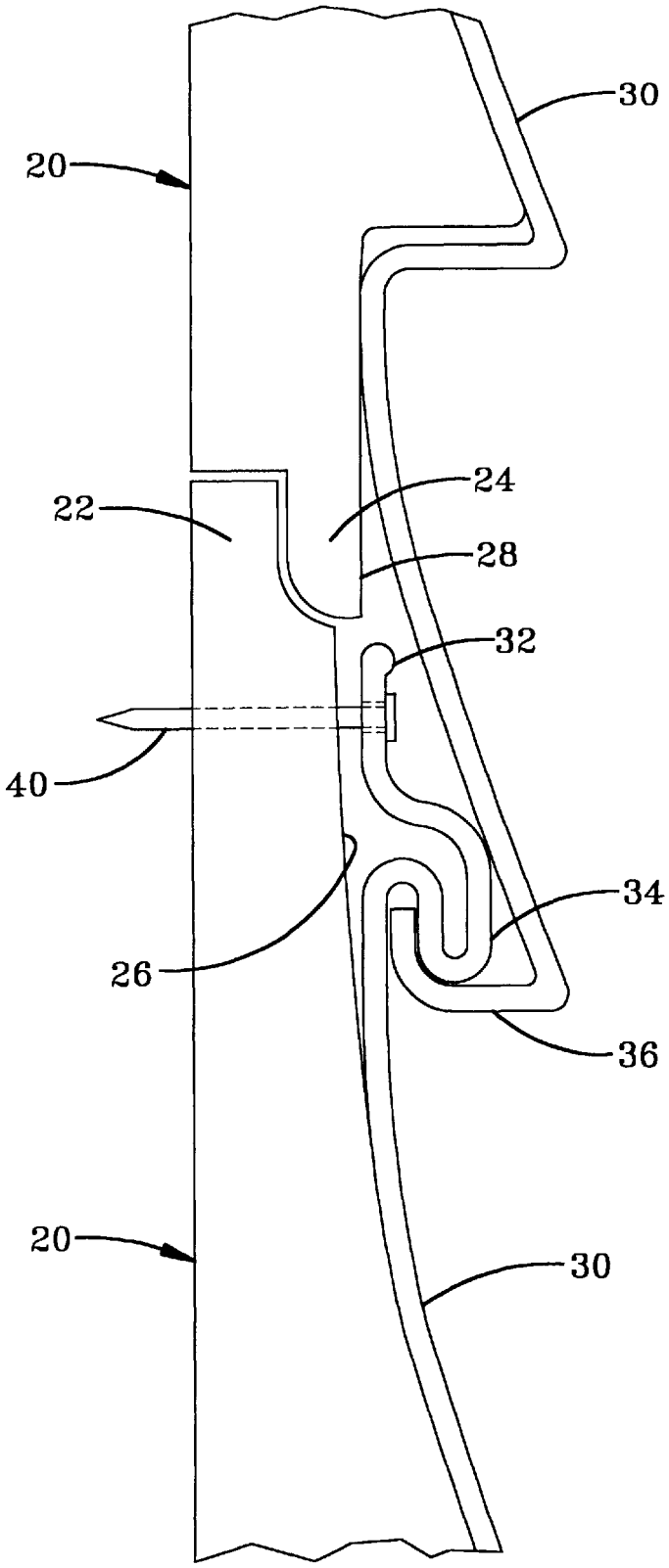
FIG. 4 is a partial side elevation view of an exemplary embodiment of a joint between siding units of the present invention.

In order to obtain a generally solid siding unit 10, a reinforcing panel 20 may be glued or otherwise laminated to the inside of the at least one facing panel 30. It is preferred that an adhesive be used to bond a portion of a reinforcing panel 20 to a portion of the inside of a facing panel 30. As shown in FIGS. 1, 4, and 5, it is preferred that a surface portion 26 of an upper portion 22 of a reinforcing panel 20 is not glued or otherwise laminated to a facing panel 30. It is also preferred, as shown in FIGS. 1, 4, and 5, that a surface portion 28 of a bottom portion 24 is not glued or otherwise laminated to a facing panel 30. By not bonding surface portion 26 or surface portion 28 to a facing panel 30, it may facilitate the interlocking of adjacent siding units 10, and it may allow for portions of a reinforcing panel 20 to be cut away if necessary.

A facing panel 30 is preferably contoured and textured to simulate the appearance of wooden siding. For the purposes of this application, a course shall be understood to mean two rows of siding. As with traditional clapboard sidings, a row of a course may be 3, 4, 5, 6, or 8 inches high. It should be recognized, however, that a row of a course may be practically any desired height, e.g., 7 inches.

One of the advantages of the present invention is the increased speed of installation. One embodiment of the present invention is a siding with reinforcing panel assembly, of at least double course dimensions. Another embodiment of the present invention is a reinforced siding unit comprising at least 1 course, e.g., 1.5 courses. As a result, there may be less handling of the present invention before and during installation than is necessary for other siding assemblies, and more courses may be simultaneously installed. Furthermore, the present invention offers a degree of rigidity not found in unreinforced vinyl siding. With the reinforcing panel secured to the vinyl siding in the present invention, a more solid structure is realized along with additional insulation value.

In the embodiment shown in FIGS. 1 through 3, a facing panel 30 simulates the appearance of one wooden course, and the siding unit 10 simulates the appearance of two substantially parallel wooden courses. However, as shown in FIG. 5, it should be recognized that a facing panel 30 may simulate the appearance of more than one wooden course, e.g., 1.5, 2, or any other desired amount of courses. The embodiment in FIG. 5 simulates the appearance of two substantially parallel wooden courses.

A facing panel 30 preferably includes a tongue 34 and a groove 36. A facing panel 30 also preferably includes an attachment strip 32. An exemplary attachment strip 32 has at least one aperture 38. The at least one aperture 38 is preferably horizontally elongated to allow for expansion and contraction of a siding unit 10.

FIG. 4 illustrates an exemplary embodiment of a joint between siding units 10 of the present invention. As shown in FIG. 4, a nail 40 may be inserted through an aperture 38 in order to secure a siding unit 10 to a building structure. As further shown in FIG. 4, the tongue 34 of a facing panel 30 is adapted to fit in the groove 36 of an adjacent facing panel 30. Moreover, the bottom portion of a facing panel 30 is adapted to conceal the attachment strip 32 and the tongue 34 of an adjacent facing panel 30.

As shown in FIG. 4, the upper portion 22 of a siding unit 10 is preferably adapted to abut, mate with, and/or interlock with the bottom portion 24 of an adjacent siding unit 10 such that there are substantially no gaps between adjacent reinforcing panels 20. The interlocking mechanism between adjacent siding units 10 is preferably reinforced by abutting, mating, and/or interlocking the upper portion 22 of one siding unit 10 to the bottom portion 24 of an adjacent siding unit 10. Moreover, this feature preferably increases the insulative value and the solid feel of siding units 10 which have been installed on a building structure.

FIG. 5 illustrates an alternative embodiment of a siding unit 10 of the present invention. In this embodiment, the siding unit 10 includes a reinforcing panel 20 and one facing panel 30. This embodiment of a facing panel 30 simulates the appearance of two substantially parallel wooden courses.

Another embodiment (not shown) of a siding unit 10 of the present invention includes a reinforcing panel 20 and at least three courses of vinyl siding. The at least three courses of vinyl siding are preferably formed by at least one facing panel 30. Each of the courses of vinyl siding has an inside. The reinforcing panel 20 is secured to the inside of each of the courses of vinyl siding. As a result, the siding unit 10 is adapted for installation as a single piece.

The length of a siding unit 10 is preferably between 10 and 25 feet in order to facilitate installation on a building structure. Again, it should be recognized that the patentability of the present invention is not dependent on the length of a siding unit 10. The length of a siding unit 10 may be any desired length less than 10 feet or greater than 25 feet.

Figure 6:
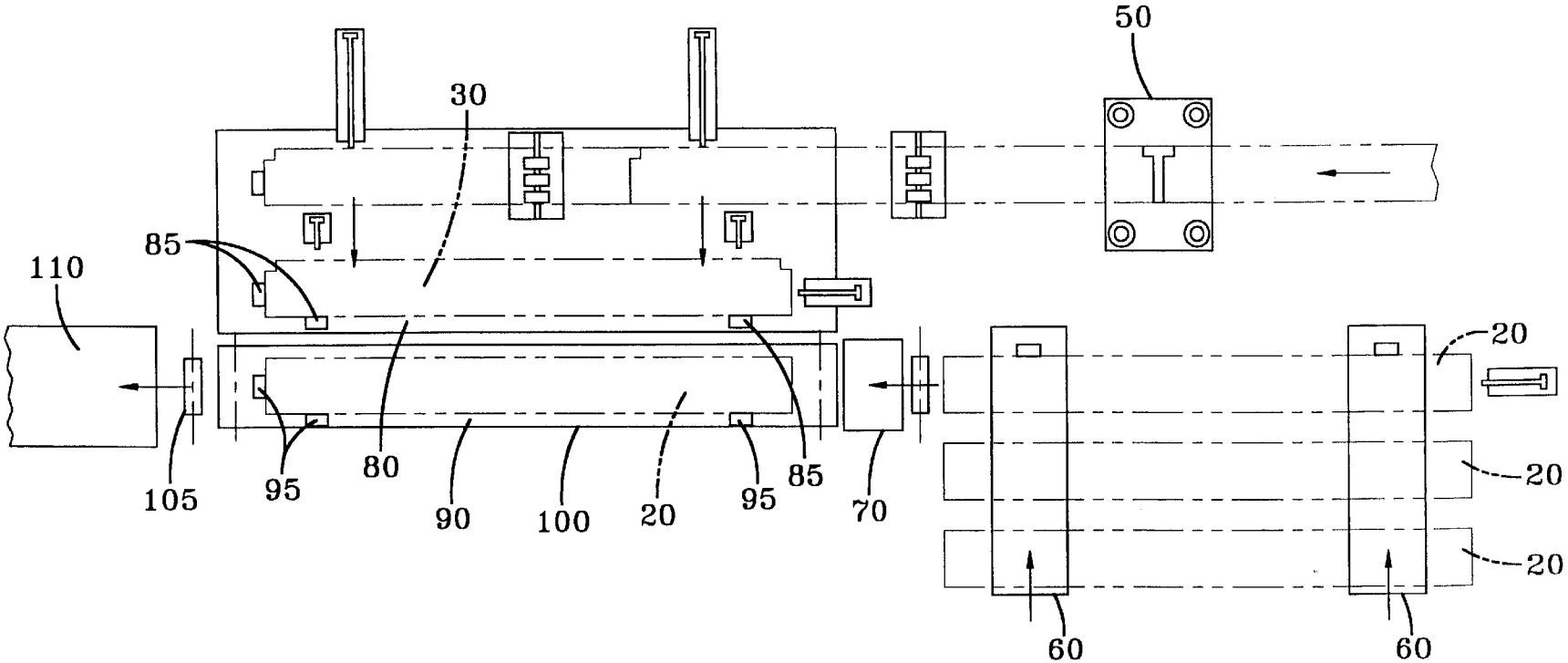
FIG. 6 is a schematic diagram of an exemplary embodiment of a system for manufacturing reinforced vinyl siding of the present invention.

FIG. 6 is a schematic diagram of an exemplary system for manufacturing a siding unit 10. As opposed to known manufacturing systems which are manually intensive, this manufacturing system is automated. Vinyl siding is extruded and passed through a cut-off and notch die 50. The cut-off and notch die 50 preferably cuts the vinyl siding into the desired shape of a facing panel 30. The facing panel 30 is then conveyed and transferred to a facing panel locating station 80. A plurality of locators 85 preferably position the facing panel 30 in a predetermined location in the facing panel locating station 80. Meanwhile, a precut reinforcing panel 20 is transferred by magazine conveyors 60 to a predetermined location. The reinforcing panel 20 is then passed through an adhesive applicator 70 which applies an adhesive to predetermined portions of the reinforcing panel 20. After passing through the adhesive applicator 70, the reinforcing panel 20 is transferred to a reinforcing panel locating station 90 on a conveyor 100. A plurality of locators 95 preferably position the reinforcing panel 20 in a predetermined location in the reinforcing panel locating station 90.

After the reinforcing panel 20 and the facing panel 30 are properly positioned in their respective locating stations, the facing panel 30 is placed or dropped into position on the reinforcing panel 20 to form a siding unit 10. At this point, the reinforcing panel 20 generally conforms to the inside of the facing panel 30. The siding unit 10 is then preferably passed through a pair of laminating exit rolls 105 to insure that the reinforcing panel 20 is adequately bonded to the facing panel 30. After passing through the laminating exit rolls 105, the siding unit 10 may be transferred on a conveyor 110 to a desired location.

The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to affect the described invention. Many of those variations and modifications will provide the same result and fall within the spirit of the claimed invention. It is the intention, therefore, to limit the invention only as indicated by the scope of the claims.

What is claimed is:

1. A siding unit adapted to be installed on a structure as a single unit, said siding unit comprising:

at least 1.5 integral courses of extruded vinyl siding, said at least 1.5 courses having an inside surface, a top edge, and a bottom edge; and at least one reinforcing panel secured to the inside surface of said at least 1.5 courses of vinyl siding, said at least one reinforcing panel having an upper portion defining a groove and a bottom portion defining a tongue, said upper portion and said groove disposed above said top edge of said at least 1.5 courses of vinyl siding, said bottom portion disposed above said bottom edge of said at least 1.5 courses of vinyl siding, said groove of said upper portion of said at least one reinforcing panel adapted to receive a tongue of a bottom portion of at least one reinforcing panel of an adjacent, substantially similar siding unit when installed;

wherein said at least 1.5 courses of vinyl siding of said siding unit are adapted to be disposed entirely below said bottom portion of said at least one reinforcing panel of said adjacent, substantially similar siding unit when installed;

wherein a portion of said at least one reinforcing panel, which is adjacent to said groove and faces said vinyl siding, is not directly secured to said vinyl siding; and wherein a portion of said at least one reinforcing panel, which is adjacent to said tongue and faces said vinyl siding, is not directly secured to said vinyl siding.

2. A method for installing siding on a structure, said method comprising:

extruding at least 1.5 integral courses of vinyl siding, said at least 1.5 courses having an inside surface, a top edge, and a bottom edge; and securing at least one reinforcing panel to said inside surface of said at least 1.5 courses of vinyl siding to provide a siding unit, said at least one reinforcing panel having an upper portion defining a groove and a bottom portion defining a tongue, said upper portion and said groove disposed above said top edge of said at least 1.5 courses of vinyl siding, said bottom portion disposed above said bottom edge of said at least 1.5 courses of vinyl siding, said groove of said upper portion of said at least one reinforcing panel adapted to receive a tongue of a bottom portion of at least one reinforcing panel of an adjacent, substantially similar siding unit when installed, said at least 1.5 courses of vinyl siding of said siding unit adapted to be disposed entirely below said bottom portion of said at least one reinforcing panel of said adjacent, substantially similar siding unit when installed;

delivering said siding unit to a site of said structure; and installing said siding unit on said structure;

wherein said at least one reinforcing panel is secured to said vinyl siding such that a portion of said at least one reinforcing panel, which is adjacent to said groove and faces said vinyl siding, is not directly secured to said vinyl siding, and a portion of said at least one reinforcing panel, which is adjacent to said tongue and faces said vinyl siding, is not directly secured to said vinyl siding.

3. A siding unit comprising:

a vinyl facing panel defining at least about 1.5 integral courses, said vinyl facing panel having an inside surface; and at least one reinforcing panel secured to said inside surface of said vinyl facing panel, said at least one reinforcing panel having an upper portion defining a groove and a bottom portion defining a tongue such that a portion of said at least one reinforcing panel, which is adjacent to said groove and faces said vinyl facing panel, is not directly secured to said vinyl facing panel, and a portion of said at least one reinforcing panel, which is adjacent to said tongue and faces said vinyl facing panel, is not directly secured to said vinyl facing panel.

* * * * *